US007121497B2

(12) United States Patent
Robitaille et al.

(10) Patent No.: US 7,121,497 B2
(45) Date of Patent: Oct. 17, 2006

(54) ANIT FALL OFF APPARATUS AND METHOD OF USE THEREOF

(75) Inventors: Martin Robitaille, 4765, rue St-Félix, St-Augustin-de-Desmaures, Quebec (CA) G3A 1B2; Steve Gagnon, Quebec (CA); Alain Carbonneau, Ancienne-Lorette (CA)

(73) Assignee: Martin Robitaille, St-Augustin-de-Desmaures (CA)

( * ) Notice: Subject to any disclaimer, the term of this patent is extended or adjusted under 35 U.S.C. 154(b) by 0 days.

(21) Appl. No.: 11/286,339

(22) Filed: Nov. 25, 2005

(65) Prior Publication Data

US 2006/0071117 A1 Apr. 6, 2006

Related U.S. Application Data

(63) Continuation-in-part of application No. 10/712,883, filed on Nov. 14, 2003, now abandoned.

(30) Foreign Application Priority Data

Nov. 5, 2003 (CA) ..... 2447498

(51) Int. Cl.
*B65H 23/00* (2006.01)
*B65H 57/18* (2006.01)

(52) U.S. Cl. ..... 242/566; 242/615.2; 242/157 R

(58) Field of Classification Search ..... 242/566, 242/615.2, 157 R, 417.2, 615.1, 550, 422.6, 242/422.5, 364.11, 471
See application file for complete search history.

(56) References Cited

U.S. PATENT DOCUMENTS

| | | | |
|---|---|---|---|
| 1,410,136 | A | 3/1922 | Stevens |
| 2,682,335 | A | 6/1954 | Welsh et al. |
| 3,589,652 | A | 6/1971 | Thompson, Jr. |
| 4,000,519 | A | 12/1976 | Turk |
| 4,917,327 | A | 4/1990 | Asbury, Jr. et al. |
| 5,029,768 | A | 7/1991 | Asbury, Jr. et al. |
| 5,692,698 | A | 12/1997 | Forbes |
| 5,775,629 | A | 7/1998 | Cyr |
| 6,078,481 | A | 6/2000 | Vanderheyden et al. |
| 6,325,324 | B1 | 12/2001 | Getz et al. |
| 6,405,957 | B1 | 6/2002 | Alexander et al. |
| 6,563,670 | B1 | 5/2003 | Brong et al. |
| 6,622,959 | B1 | 9/2003 | Robitaille |
| 2002/0059982 | A1 | 5/2002 | Hartman et al. |

*Primary Examiner*—William A. Rivera
*Assistant Examiner*—William E. Dondero
(74) *Attorney, Agent, or Firm*—Robert Brouillette

(57) ABSTRACT

An apparatus to prevent strip material from falling off the edges of a strip material package when unwinding. The package comprises a generally cylindrical and flangeless core around which the strip material is wound transversely in a plurality of overlapping layers. The apparatus also includes an idler roller. When unwinding, the strip material goes around the idler roller, then around the package, generally in its central portion and then again around the idler roller before being fed to a laminating machine. A method to use the apparatus is also provided.

21 Claims, 2 Drawing Sheets

ANIT FALL OFF APPARATUS AND METHOD OF USE THEREOF

RELATED APPLICATION DATA

This present application is a Continuation-in-part of commonly assigned U.S. patent application Ser. No. 10/712,883, filed on Nov. 14, 2003 now abandoned and entitled "Anti-Fall Off Apparatus".

FIELD OF THE INVENTION

The invention relates to the field of strip material dispensing and more particularly, to an apparatus and method to prevent the fall of a strip material from a tape package.

BACKGROUND OF THE INVENTION

This invention relates to an improvement in an apparatus for dispensing a strip material, i.e. tape, ribbon, web, string or the like, generally referred to hereinafter as "tape" or "strip material", when the tape is being unwound at a laminating machine such as a corrugating machine or press. One aspect of the present invention is to prevent the tape from falling off the edge of the tape package when unwinding. Another aspect is to prevent the tape from twisting in the dispensing equipment.

Reinforcing or tear tapes have been used for many years in modern packaging as an aid to maintain structural integrity or as an easy open feature in boxes, packages and/or containers. One limitation of the dispensing equipment used at the laminating machine is the difficulty to prevent the tape from falling off the edge of the tape package. To be able to put a reasonable amount of linear footage on a tape package, the use of a cross winding principle is mandatory. Therefore, for a tape with a width of ½ inch, the tape package can be 13 to 18 inch wide, with a diameter up to 18 inches. As a result, the tape is wound on the package with a traverse pattern so that when the tape is wound around a spindle or core, the tape is also moved in a back and forth motion along the length of the spindle or core. The ratio between the number of revolutions of the spindle over the stroke of the tape along the length of the spindle is known as the winding ratio. Since the tape can be slippery at room temperature, there is a danger that, when the tape reaches the edge of the tape package and stays there until it changes direction to go back toward the middle of the package, it can come off the edge of the tape package and fall off down to the spindle of the tape package. When that happens, the tape cannot go back to the delivering surface of the tape package and the package will stop delivering tape with the undesirable result that the tape breaks.

To prevent the tape from coming or falling off the edge of the tape package, the tape industry has used different techniques such as: adhesive formulation providing added tack between the layers of the tape package, faster winding ratios to try to limit the amount of time when the tape is positioned near the edge of the tape package, roll flanges made of hard materials or paper coated with pressure sensitive adhesives placed on the edges of the tape package to create a physical barrier to prevent the tape from falling off the edge of the tape package, and so on. Each of these techniques have their drawbacks which can reduce tape performance at the laminating machine. For example, increasing the tack of the adhesive formulation of the tape can diminish the performance of the tape in the laminating process or can cause other tape dispensing problems such as pulleys becoming gummed with adhesive deposits coming from the adhesive of the tape. Another example is the tape that can be damaged by the physical barrier on the edges of the tape package, when the physical barrier rubs on the sides of the tape during shipment.

The literature is abundant with tape dispenser systems and tape splicing systems for unwinding tape packages at laminating machines or presses. Often the literature is describing splicing system, as all tape must be fed to continuously running processes and since all tape packages contain a very limited amount of linear footage, the splicing feature becomes a critical element. We can see this in the following patents (or application): U.S. Pat. No. 4,917,327; U.S. Pat. No. 5,029,768; U.S. 2002/0059982; U.S. Pat. No. 6,325,324; U.S. Pat. No. 5,775,629 and U.S. Pat. No. 6,622,959. It would be evident to someone outside this industry that the simplest way to diminish the criticality of the splicing system would be to increase the amount of linear footage on a tape package. But as the industry is well aware, one of the main reason why tape packages are not made larger is that as the diameter of the tape package increases, the amount of time that the tape stays at the edge of the package increases, thus increasing the dangers of having tape fall offs to a point where it becomes a major problem. This invention solves this problem, as any increases in the tape package diameter does not increase the occurrence of fall offs.

SUMMARY OF THE INVENTION

The present invention is directed to an apparatus providing a means to prevent the tape from falling off the edges of the tape package.

As used hereinafter, the term tape package generally refers a device comprising a generally cylindrical and flangeless core or spindle around which tape or other similarly narrow flat material is transversely wound in a plurality of overlapping layers. These tape packages generally come in the form of roll, drum, reel and the like.

The apparatus further comprises an idler roller preferably positioned near the unwinding tape package. When the tape is dispensed and thus unwound, the tape, coming off the tape package, is lead around the idler roller and then back around the tape package at least once and from there to the system dispensing the tape to the laminating machine. In this manner, when the tape is coming off the tape package, it goes around the idler roller and tape package at least once before going through the rest of the dispensing system, effectively creating at least one loop of tape going around the idler roller/tape package combination. This apparatus and method thus prevents the tape from falling off the tape package because the tape leaving the package at the nip point is being pulled toward the center of the tape package by the preceding loop of tape going around the idler roller/tape package combination. Without that innovation, when the tape leaves the tape package at the moment where the tape is at its edge, the tape actually will generally try to find the shortest route, which, in this case, is going off the side of the tape package; a defect called a fall-off.

With this innovation, we use the fact that the tape is always somewhat slippery between each layers on the tape package. Therefore, when the tape first leaves the tape package during unwinding, it is pulled away from the edge of the tape package and toward the center of the tape package by the preceding loop of tape. This movement toward the center of the package is the result of the fact that the preceding loop of tape going around the idler roller/tape package combination is ahead in the winding pattern of the tape package.

Alternatively, when the tape leaves the idler roller/tape package combination for the last time before going to the rest of the dispensing system and toward the laminating machine, it has already been pulled off the tape package at least once. Therefore, being generally loose on the idler roller/tape package combination, the tape can be pulled toward the center of the package and away from the tape package edges by the geometry of the tape dispenser.

As a result, the tape is always pulled toward the center of the tape package either by the preceding loop around the idler roller tape/package combination or by the geometry of the dispenser when the tape finally leaves the idler roller tape package combination.

Another improvement resulting of the use of the loop of tape around the idler roller/tape package combination, is the fact that the tape stays flat at all time during unwinding. Even if the tape is being pulled to the center of the tape package by the geometry of the tape dispenser and/or by the traverse winding of the tape package, the loop of tape around the idler roller/tape package combination helps prevent the tape from twisting further along the tape dispensing equipment.

Accordingly, the apparatus of the present invention comprises a system for dispensing strip material from a package comprising a generally cylindrical and flangeless core around which the strip material is wound transversely in multiple overlapping layers. The package is preferably mounted for rotation about an axis. According to the present invention, the strip is lead around an idler roller, also mounted for rotation, around the package and preferably again around the idler roller before being fed to other parts of a dispensing system, whereby fall off of said strip material from the package is avoided.

The present invention also provides a method of dispensing a strip material wound transversely on a package comprising a core or spindle and mounted for rotation about a first axis comprising the following steps:

placing an idler roller along a second axis parallel to said first axis;

leading said strip material around said idler roller;

leading said strip material around said package;

leading said material again around the said idler roller.

These and other novel features of the invention will be more fully described herein below.

BRIEF DESCRIPTION OF THE DRAWINGS

The present invention will be described with reference to the accompanying drawing wherein.

DETAILLED DESCRIPTION OF THE INVENTION

Figure 1:
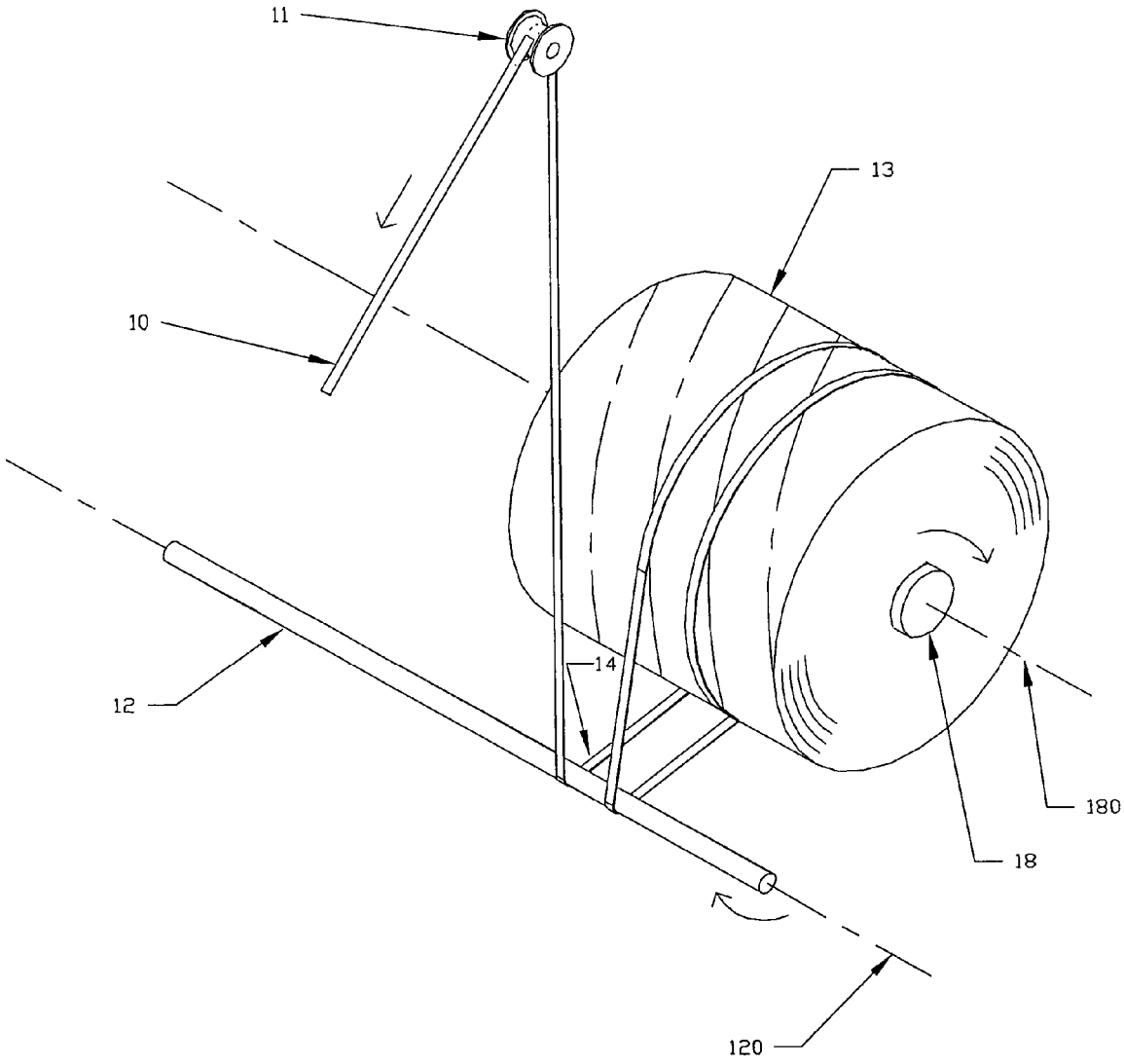
FIG. 1 is a view of the tape package, idler roller and first pulley of tape dispenser system.
Figure 2:
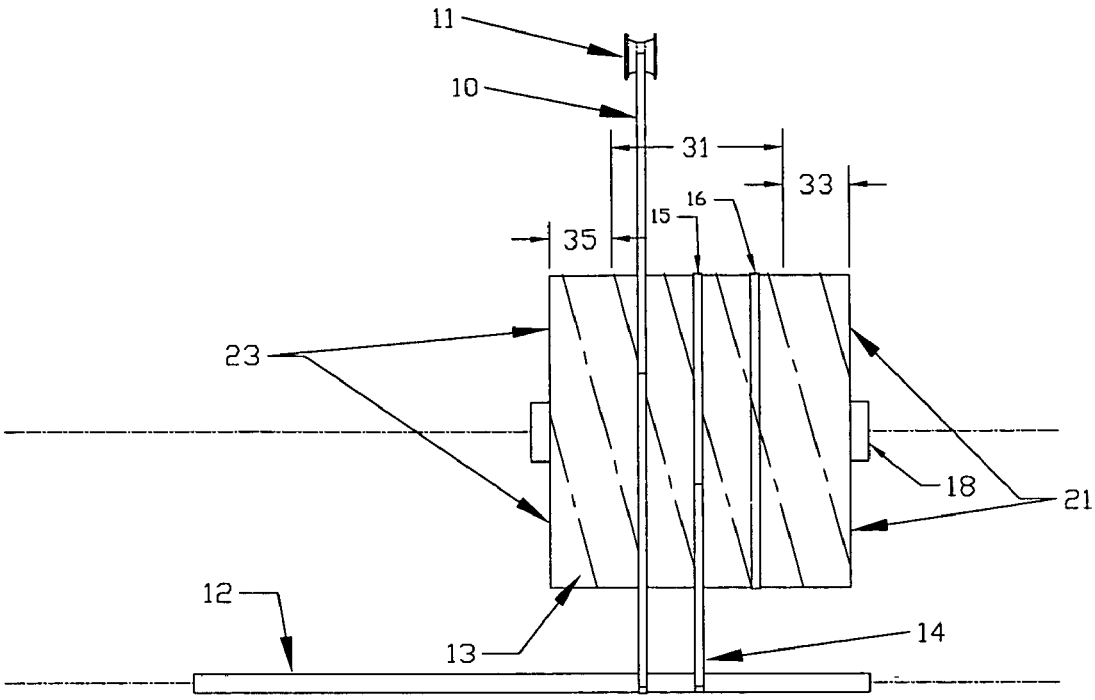
FIG. 2 is a top view of the tape package, idler roller and first pulley of tape dispenser system.
Figure 3:
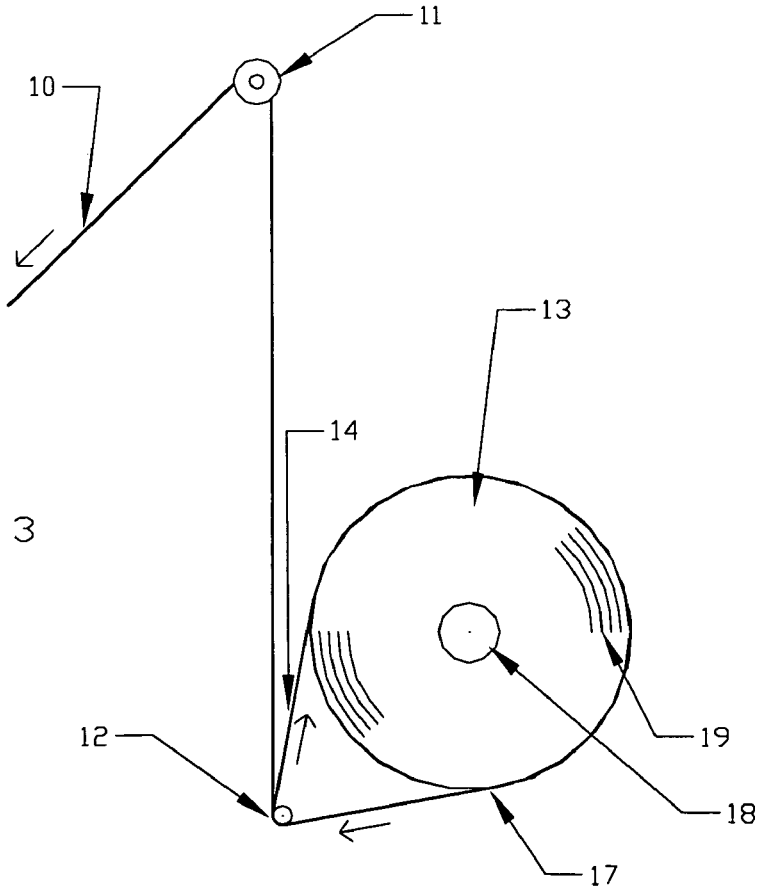
FIG. 3 is a side view of the tape package, idler roller and first pulley of tape dispenser system.

The present invention provides an improved apparatus for the dispensing of a tape 10 at preferably but not exclusively the corrugating machine or press (not shown). As shown in FIGS. 1–3, a tape package 13 is unwound. The tape package 13, mounted for rotation about an axis 180, preferably comprises a generally cylindrical and flangeless core or spindle 18 around which the tape 10 is wound with a traverse wind ratio as can be seen by the tape paths 14, 15 and 16 around the tape package 13 and the dash lines in FIGS. 1 and 2. The skilled addressee will understand that the traverse wind ratio has been exaggerated for illustrative purposes. Furthermore, the tape 10 on the tape package 13 is wound in a plurality of overlapping layers 19 as shown by the dash lines in FIG. 3. Again, since the tape is generally thin, the dash lines of FIG. 3 have been exaggerated for illustrative purposes. The reason for this kind of winding is known in the art but in a nutshell, it is to improve the ratio between the linear footage of tape 10 contained in the package 13 to the size of the package 13.

Since the tape 10 is wound in a transverse fashion, the tape 10 generally moves back and forth between the edges 21 and 23 of the tape package 13 as the tape 10 is being dispensed. As the tape 10 reaches one of the edges 21 and 23, there is a risk that the tape 10 may fall from the package 13. Adding flanges to the package 13 cannot be contemplated since the flanges could damage the tape 10.

Therefore, when the tape 10 first leaves the nip point 17 of the tape package 13, it is pulled around an idler roller 12 which is located preferably near the tape package 13 and preferably parallel to the package 13. The idler roller 12 is generally mounted for rotation about an axis 120.

The tape 10 is then pulled around again but this time around the tape package 13, preferably in its central portion 31. By pulling the tape 10 around the idler roller 12 and the tape package 13 in its central portion, the tape 10 is always pulled toward the central portion 31 of the package 13 and preferably away from the lateral portions 33 and 35 and most importantly, away from the edges 21 and 23. This way, the risk that the tape 10 may fall off the package 13 is greatly reduced without damaging the tape 10.

The tape is then preferably pulled around the idler roller 12 a second time before being fed to the corrugating or laminating machine (not shown) via a pulley 11. Understandably, tape 10 for use in other industries could be fed to other types of machines without departing from the scope of the invention.

Also, the skilled addressee will readily understand that depending on the size of the tape package 13 and the type of tape 10 used, it is contemplated that the tape 10 might be pulled around the idler roller 12 more than two times and around the package 13 more than one time.

Having described the invention with reference to accompanying illustrations of the apparatus of the present invention, it is contemplated that engineering changes can be made without departing from the spirit or scope of the invention as set forth in the appended claims.

The invention claimed is:

1. A system for dispensing strip material from a package, said package comprising a generally cylindrical flangeless core having a first width and around which said strip material is transversely wound in a plurality of overlapping layers, said strip material having a second width smaller than said first width, said package defining two edges and comprising a central portion and two opposite lateral portions located on each side of and adjacent to said central portion, said package being mounted for rotation about a first axis, said system further comprising an idler roller generally mounted for rotation about a second axis, wherein said strip material being dispensed is first lead around said idler roller, then around said package generally in its central portion, then again around said idler roller and finally fed to other parts of a dispensing machine, whereby fall off of said strip material from at least one of said edges is avoided.

2. A system as claimed in claim 1 wherein said first axis and said second axis are horizontal.

3. A system as claimed in claim 1 wherein said first axis and said second axis are parallel.

4. A system as claimed in claim 1 wherein said first axis and said second axis are parallel and horizontal.

5. A system as claimed in claim 1 wherein strip material is a reinforcing or tear tape.

6. A system for dispensing strip material from a package, said package comprising a generally cylindrical flangeless core having a first width and around which said strip material is transversely wound in a plurality of overlapping layers, said strip material having a second width smaller than said first width, said package defining two edges and comprising a central portion and two opposite lateral portions located on each side of and adjacent to said central portion, said package being mounted for rotation about a first axis, said system further comprising an idler roller generally mounted for rotation about a second axis, wherein said strip material being dispensed is first lead around said idler roller, then around said package generally in its central portion, then again around said idler roller and finally fed to other parts of a dispensing machine, whereby said strip material is pulled toward said central portion whereby fall off of said strip material from at least one of said edges is avoided.

7. A system as claimed in claim 6 wherein said first axis and said second axis are horizontal.

8. A system as claimed in claim 6 wherein said first axis and said second axis are parallel.

9. A system as claimed in claim 6 wherein said first axis and said second axis are parallel and horizontal.

10. A system as claimed in claim 6 wherein strip material is a reinforcing or tear tape.

11. A system for dispensing strip material from a package, said package comprising a generally cylindrical flangeless core having a first width and around which said strip material is transversely wound in a plurality of overlapping layers, said strip material having a second width smaller than said first width, said package defining two edges and comprising a central portion and two opposite lateral portions located on each side of and adjacent to said central portion, said package being mounted for rotation about a first axis, said system further comprising an idler roller generally mounted for rotation about a second axis, wherein said strip material being dispensed is lead around said idler roller and then around said package generally in its central portion at least one time before being fed to other parts of a dispensing machine, whereby fall off of said strip material from at least one of said edges is avoided.

12. A system as claimed in claim 11 wherein said first axis and said second axis are horizontal.

13. A system as claimed in claim 11 wherein said first axis and said second axis are parallel.

14. A system as claimed in claim 11 wherein said first axis and said second axis are parallel and horizontal.

15. A system as claimed in claim 11 wherein strip material is a reinforcing or tear tape.

16. A method of dispensing a strip material from a package comprising a generally cylindrical and flangeless core around which said strip material is wound transversely in a plurality of overlapping layers, said package being mounted for rotation about a first axis, said method comprising the following steps:

a. placing an idler roller along a second axis parallel to said first axis;

b. leading said strip material around said idler roller;

c. leading said strip material around said package;

d. leading said material again around the said idler roller.

17. A method as claimed in claim 16 wherein the said axes are horizontal.

18. A method as claimed in claim 16 wherein strip material is a reinforcing or tear tape.

19. A method as claimed in claim 16 wherein said package further comprises two lateral portions and a central portion located between said two lateral portions and wherein said step c) further comprises the leading of said strip material generally around said central portion of said package.

20. A method as claimed in claim 19 wherein the said axes are horizontal.

21. A method as claimed in claim 19 wherein strip material is a reinforcing or tear tape.

* * * * *